US006659077B2

(12) United States Patent
Morikami

(10) Patent No.: US 6,659,077 B2
(45) Date of Patent: Dec. 9, 2003

(54) CONTROL SYSTEM AND CONTROL METHOD OF ENGINE

(75) Inventor: Tadaaki Morikami, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 10/022,865

(22) Filed: Dec. 20, 2001

(65) Prior Publication Data

US 2002/0088429 A1 Jul. 11, 2002

(30) Foreign Application Priority Data

Dec. 21, 2000 (JP) ..... P2000-389231

(51) Int. Cl.[7] ..... F02P 9/00
(52) U.S. Cl. ..... 123/319; 123/481; 123/333
(58) Field of Search ..... 123/333, 332, 123/319, 198 D, 481

(56) References Cited

U.S. PATENT DOCUMENTS 4,695,822 A * 9/1987 Furukawa ..... 123/41.15

6,520,159 B2 * 2/2003 White et al. ..... 123/481

OTHER PUBLICATIONS

U.S. patent application Ser. No. 10/022,408, filed Dec. 20, 2001, pending.

* cited by examiner

*Primary Examiner*—Bibhu Mohanty
(74) *Attorney, Agent, or Firm*—Oblon, Spivak, McClelland, Maier & Neustadt, P.C.

(57) ABSTRACT

A water-cooled multi-cylinder engine, includes a control system in which an engine revolution number is reduced to a level less than a restriction revolution number on the basis of at least one condition of misfire and fuel stop for all the cylinders of the engine, at a time of an occurrence of an overheat, so as to restrict an increasing of a temperature of the engine. In a case when the engine revolution number is less than the restriction revolution number after the overheat occurs, or the engine revolution number is lowered to be less than the restriction revolution number on the basis of the revolution number restriction control, a specific cylinder is controlled to be stopped by at least one of misfire and fuel stop.

7 Claims, 5 Drawing Sheets

CONTROL SYSTEM AND CONTROL METHOD OF ENGINE

BACKGROUND OF THE INVENTION

1. Field of the Invention

The present invention relates to a control system, and more particularly, a control system and a control method of a water-cooled multi-cylinder engine, which is utilized at a time of an overheat of the engine.

2. Description of the Related Art

In a compact four-stroke-cycle multi-cylinder engine, which is mounted, for example, to an outboard motor or like, there is provided a structure adapted to employ a water-cooled type engine cooling method. In a concrete example of a cooling water passage structure, for example, a cooling water such as a sea water, a lake water or the like sucked from a water intake port is pressurized by a water pump so as to be introduced to the engine.

In this case, when the water intake port for the cooling water is clogged by an algae or the like or a water pump gets out of order, an overheat of the engine will be caused due to shortage of the cooling water. In order to obviate such defect, there is provided a structure having a control system for executing a misfire of an ignition plug, stopping of a fuel injection or fuel supply, or like so as to reduce an engine revolution number, thereby restricting an ascent of an engine temperature.

However, in the engine provided with such control system as mentioned above, even if the engine remains the overheat state, a normal ignition and a normal injection are executed in the case where the engine revolution number becomes lower than a limited revolution number, and, hence, a normal operation would be executed.

There is no problem in the case of, for example, clogging of the water intake port or the like, which can relatively easily solved. However, in the case of a problem which is not easily solved on the scene, for example, a roughness on the sea condition, a trouble of the water pump or the like, it is obliged for the engine to be driven even in the overheat state, and in such case, the temperature of the engine will have to be further increased. Accordingly, there is a fear that an excessive damage is applied to equipment such as electrical equipment arranged in an engine main body or at a periphery thereof.

SUMMARY OF THE INVENTION

The present invention is made by taking the above matters encountered in the prior art mentioned above into consideration, and an object of the present invention is to provide a control system and a control method of an engine capable of rendering the engine usable while minimally restricting an engine damage due to an overheat.

This and other objects can be achieved according to the present invention by providing, in a general aspect, a control system of an engine of a water-cooled multi-cylinder structure, in which an engine revolution number is reduced to a level less than a restriction revolution number on the basis of at least one condition of revolution number restriction controls including a misfire and a fuel stop for all cylinders of the engine, at a time of an occurrence of an overheat of the engine, so as to restrict an increasing of a temperature of the engine, wherein in a case when the engine revolution number is less than the restriction revolution number after the overheat occurs, or the engine revolution number is lowered to be less than the restriction revolution number on the basis of the revolution number restriction control after the overheat occurs, a specific cylinder is controlled to be stopped by means of at least one of the misfire and the fuel stop.

In a preferred embodiment, the specific cylinder controlled to be stopped by at least one means of the misfire and the fuel stop corresponds to first and fourth cylinders or second and third cylinders in a case of a four-stroke-cycle 4-cylinder engine, corresponds to first and second cylinders or third and fourth cylinders in a case of a two-stroke-cycle 4-cylinder engine, and corresponds to any one of cylinders in a case of a 3-cylinder engine.

When the specific cylinder is controlled to be stopped on the basis of the occurrence of the overheat, an idle target revolution number of the engine is set to a revolution number higher than a target revolution number at a time of normal operation period.

When a reason of the overheat is cancelled during the stop control of the specific cylinder, the stop control of the specific cylinder is set to be cancelled only at a time when a shift apparatus takes a neutral.

The engine is an engine for an outboard motor in which a crankshaft is vertically arranged.

In a specified aspect, there is provided a control system of an engine of a water-cooled multi-cylinder structure for controlling an overheat (i.e., revolution number) of the engine, comprising:

- an element for detecting an occurrence of an overheat of an engine;
- an element for monitoring and detecting an engine revolution number;
- an element for discriminating whether the detected engine revolution number exceeds or not a restriction revolution number after occurrence of the overheat; and
- an element for performing an operation stop control to a specific cylinder by means of at least one condition of revolution number restriction controls including misfire and fuel stop to thereby reduce the engine revolution number.

In anther aspect, there is provided a method of controlling an engine of a water-cooled multi-cylinder structure for controlling an overheat (i.e., revolution number) of the engine, comprising the steps of:

- detecting an occurrence of an overheat of an engine;
- monitoring and detecting an engine revolution number;
- discriminating whether the detected engine revolution number exceeds or not a restriction revolution number after occurrence of the overheat; and
- performing an operation stop control to a specific cylinder by means of at least one condition of revolution number restriction controls including misfire and fuel stop to thereby reduce the engine revolution number.

According to the present invention of the aspects mentioned above, in the water-cooled multi-cylinder engine provided with the control system reducing the engine revolution number to the level less than the restriction revolution number, the structure is considered so that when the engine revolution number is less than the restriction revolution number after the occurrence of the overheat, or the revolution number is lowered to be less than the restriction revolution number on the basis of the revolution number restricting control, the specific cylinder of the engine is controlled to be stopped by at least one means of the misfire and the fuel stop. Therefore, it is possible to prevent the engine temperature from being increased even when the engine is continuously used at a time of occurrence of the overheat.

Furthermore, since the multi-cylinder engines can be controlled in accordance with the numbers of the cylinders, it is possible to obtain a stable engine revolution even when the engine is continuously used.

Furthermore, according to the preferred embodiment, it is possible to obtain a stable engine revolution even in a low revolution number range of the engine.

Furthermore, when the reason of the overheat is cancelled during the stop control of the specific cylinder of the engine, the stop control of the specific cylinder can be set to be cancelled only at a time when the shift apparatus takes its neutral position. It is therefore possible to prevent the engine revolution number from being rapidly increased after canceling the stop control.

The nature and further characteristic features will be made more clear from the following descriptions made with reference to the accompanying drawings.

DESCRIPTION OF THE PREFERRED EMBODIMENT

A preferred embodiment of the present invention will be described hereunder with reference to the accompanying drawings.

Figure 1:
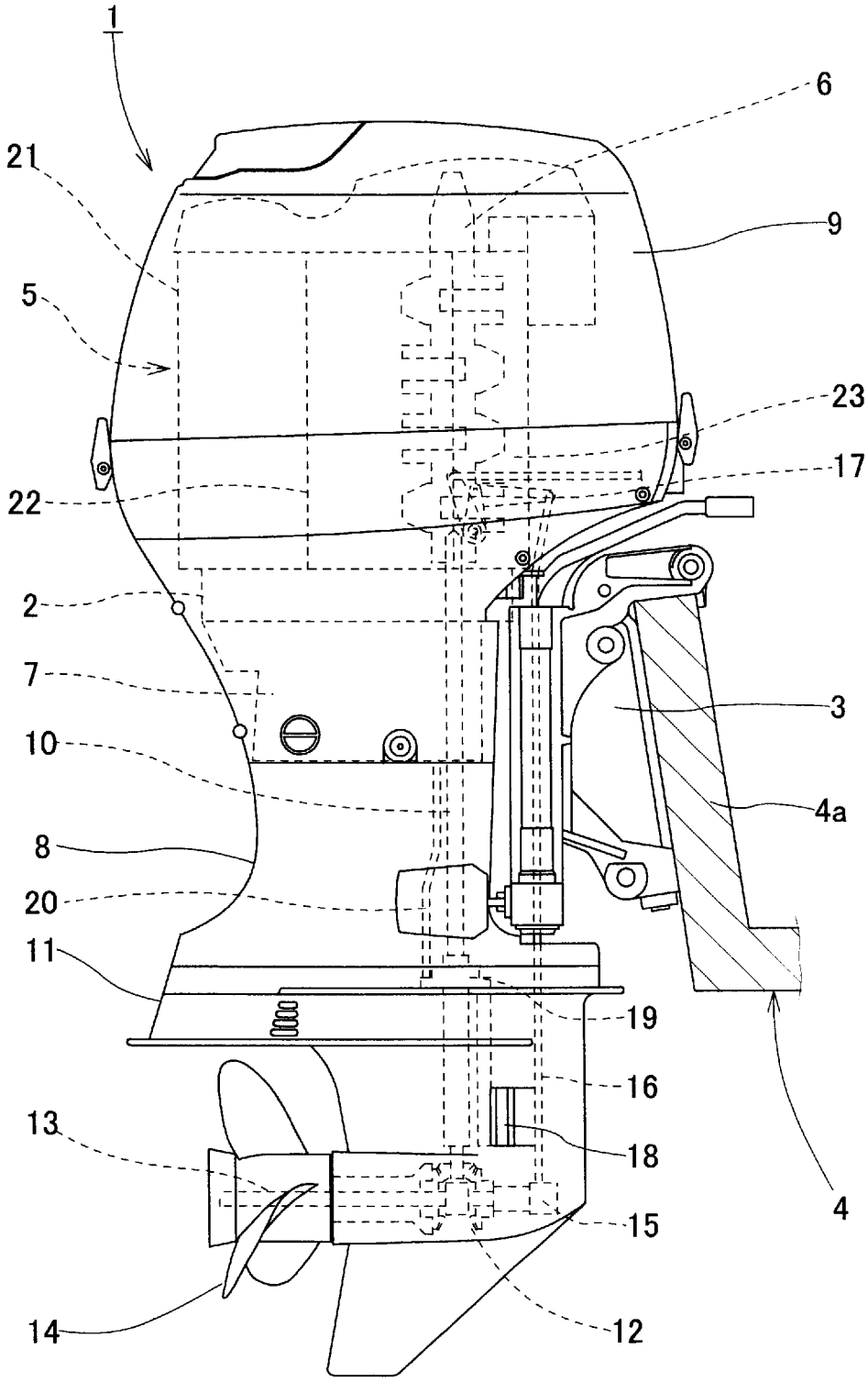
FIG. 1 is a right side elevational view of an outboard motor provided with a control system of an engine according to the present invention.

First, with reference to FIG. 1, showing the right side elevational view of an outboard motor to which the present invention is applied, the outboard motor 1 is attached to a transom 4*a* of a hull 4 through a bracket 3. The bracket 3 is mounted to an engine holder 2 of the outboard motor 1.

The engine holder 2 is formed therein with an exhaust passage and a drain passage, which will be mentioned below, but not shown, and an engine (or engine unit) 5 is disposed above the engine holder 2. Further, a crankshaft 6 is provided within the engine 5 in a vertical attitude so as to extend vertically as viewed. Furthermore, a drive shaft housing 8 is placed below the engine holder 2 through an oil pan 7 including an exhaust passage and a drain passage, which will be mentioned below, but not shown. An outer periphery of the engine 5 is covered by an engine cover 9.

A drive shaft 10 connected to a lower end of the crankshaft 6 is arranged so as to extend downward in the oil pan 7 and the drive shaft housing 8 and to drive a propeller 14 via a bevel gear 12 and a propeller shaft 13 arranged within a gear case 11 provided below the drive shaft housing 8.

Further, in the gear case 11, there is located a shift or shifting apparatus 15 for shifting a revolution direction of the propeller shaft 13 and the propeller 14 to a forward, reverse or neutral direction through a remote control. A shift rod 16 extends upward from the shift apparatus 15 and is connected to a link mechanism 17 provided in the engine cover 9.

Furthermore, a water intake port 18 is formed on a side surface of the gear case 11, and a cooling water such as a sea water, a lake water or the like is taken therein from the water intake port 18 and then fed under pressure towards the engine 5 via a cooling water pipe 20 by a water pump 19 which is driven by the drive shaft 10. Further, the cooling water fed towards the engine 5 is discharged out of the outboard motor together with an exhaust gas after cooling the respective portions in the engine unit 5.

Figure 2:
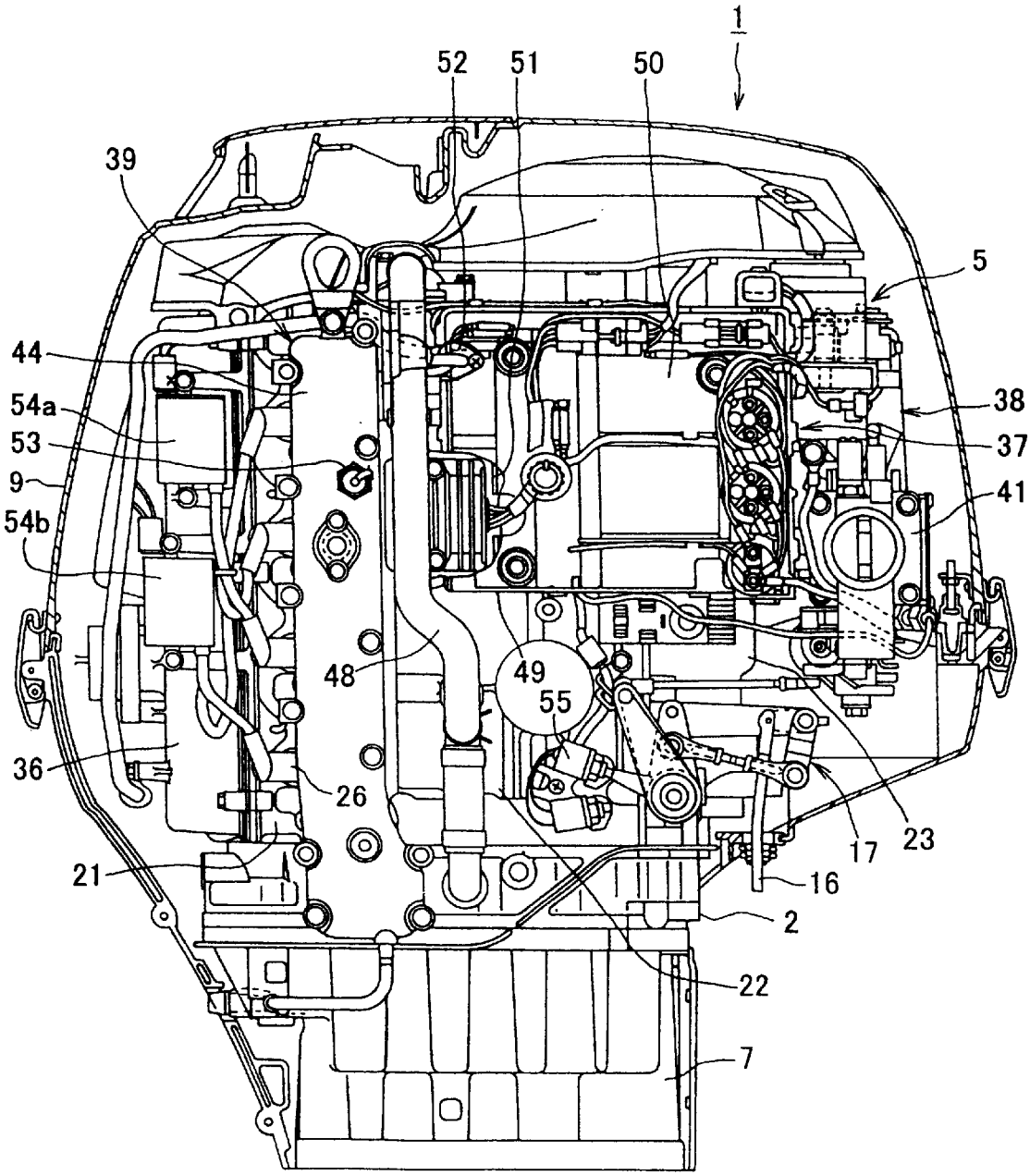
FIG. 2 is a right side elevational view showing an engine portion, in an enlarged scale, of the outboard motor shown in FIG. 1.
Figure 3:
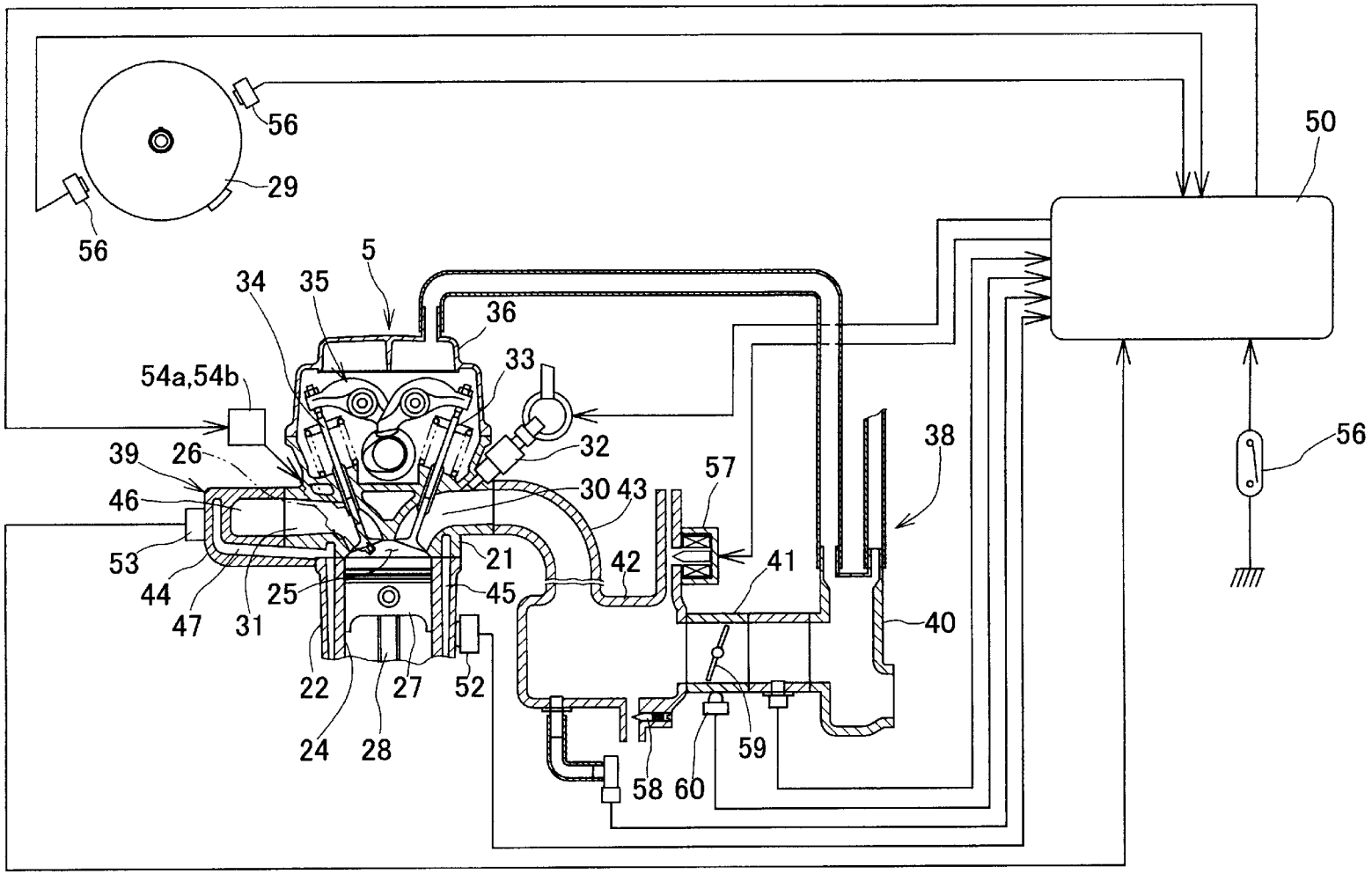
FIG. 3 is a system chart of an engine unit for the outboard motor shown in FIG. 1.

Next, with reference to FIGS. 1 to 3, the engine 5 is, for example, a water-cooled four-stroke-cycle 4-cylinder engine, and in the engine 5, a cylinder head 21, a cylinder block 22, a crank case 23 and the like are arranged in a lateral direction in the illustrated example.

A cylinder 24 is formed within the cylinder block 22 of the engine 5. Further, a combustion chamber 25 aligned with the cylinder 24 is formed in the cylinder head 21, and an ignition plug 26 is connected from the outside thereof. A piston 27 is slidably inserted in the cylinder 24, and although a detailed illustration is omitted, the piston 27 and the crankshaft 6 are connected through a connection rod 28. Further, in the illustrated structure, a reciprocating stroke of the piston 27 is converted into a rotational (or rotating) motion of the crankshaft 6. Furthermore, although a detailed illustration is omitted, a flywheel magnet 29 is mounted to an upper end of the crankshaft 6 so as to be integrally rotated therewith.

An intake port 30 and an exhaust port 31 are formed within the cylinder head 21 so as to be connected to the combustion chamber 25. Further, a fuel injector 32 for injecting a fuel in the intake port 30 is mounted to the cylinder head 21 from the outside thereof. A valve driving mechanism such as valve train 35 including an intake valve 33 and an exhaust valve 34 for opening and closing both the ports 30 and 31 is arranged in the cylinder head 21 and covered by a cylinder head cover 36.

An electronic equipment 37, an intake apparatus 38 and an exhaust apparatus 39 are arranged around the engine 5. The intake apparatus 38 mainly comprises a silencer 40, a throttle body 41, a surge tank 42 and an intake manifold 43 provided with a plurality of intake pipes extending from the surge tank 42 to the respective cylinders, and they are collected and arranged in one side of the cylinder block 22, though the detailed explanations thereof are omitted herein.

On the other hand, the exhaust apparatus 39 is arranged on a side opposing to the intake apparatus 38, and the electronic equipment 37 is also collected and arranged in the same side as that of the exhaust apparatus 39. The exhaust apparatus 39 has an exhaust manifold 44, which is supported by a side surface of the cylinder head 21 and a side surface of the engine holder 2.

A water jacket 45 is formed at the periphery of the cylinder 24 in the cylinder block 22 and at the periphery of the combustion chamber 25 of the cylinder head 21. Further, an exhaust passage 46 is formed in the exhaust manifold so as to connect the exhaust port 31 of the cylinder block 22 to an exhaust passage, not shown, formed in the engine holder 2 and the oil pan 7. A water jacket 47 is also formed in the periphery of the exhaust passage 46.

A cooling water outlet, not shown, of the water jacket 45 is formed in the cylinder block 22 and arranged above the cylinder block 22. A drain hose 48 is connected to the cooling water outlet so as to extend downward, and the drain hose 48 has a downstream end connected to a cooling water drain passage, not shown, formed in the engine holder 2 and the oil pan 7 to thereby discharge the cooling water into the drive shaft housing 8.

An electronic equipment holder 49 is arranged to a side surface of the engine 5 and in front of the exhaust manifold 44, and a control system or apparatus 50 for controlling the engine 5 is arranged therein. Further, a rectifier/regulator 51 is arranged between the exhaust manifold 44 and the electronic equipment holder 49.

Further, a cylinder temperature sensor 52 for detecting a cylinder temperature is provided, for example, on a side surface of the cylinder block 22 above the rectifier/regulator 51, and a manifold temperature sensor 53 for detecting a temperature of the exhaust manifold 44 is also provided on a side surface of the exhaust manifold 44.

Furthermore, in the arrangement of the 4-cylinders (first to fourth cylinders from top to down as shown), an ignition coil 54*a* for second and third cylinders from the top is provided in an upper side of a side surface of the cylinder head cover 36, and also, an ignition coil 54*b* for first and fourth cylinders from the top is provided in a lower side.

Still furthermore, a neutral switch 55 for detecting whether or not a shift position is neutral is disposed at a portion near the link mechanism 17 of the shift apparatus 15.

As shown in FIG. 3, a crank angle sensor 56 for detecting an angle of revolution of the crankshaft 6 is provided near an outer peripheral surface of the flywheel magnet 29. Further, an IAC (idle-air-control) solenoid valve 57 for adjusting an amount of air during the idling operation of the engine is disposed in the surge tank 42, and an air bypass screw 58 is also arranged. Further, a full-close switch 60 executing an operation, at a time when a throttle valve 59 provided in an inner portion of the throttle body 41 is fully closed, is disposed in the throttle body 41.

Figure 4:
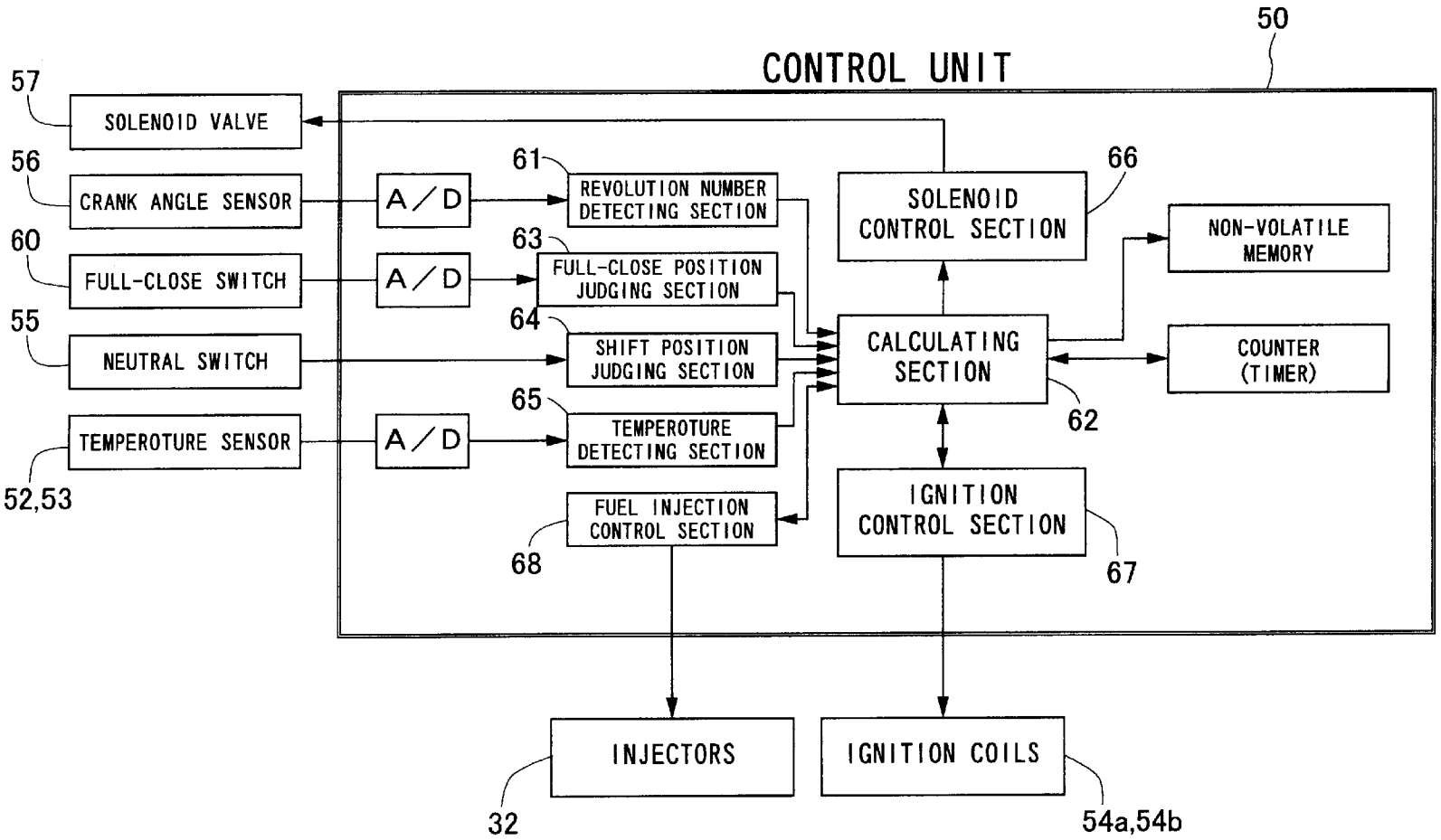
FIG. 4 is a block diagram of the engine unit shown in FIG. 3.

FIG. 4 is a block diagram of an engine system including the engine 5 shown in FIG. 3. As shown in FIG. 4, an information obtained from each of the sensors and the switches is transmitted to a control system or unit 50. In particular, the angle of revolution of the crankshaft 6 is transmitted from the crank angle sensor 56 to a revolution number detecting section 61 after an operation of an analogue-to-digital (A/D) conversion, and data of the engine revolution number obtained here is transmitted to a calculating section 62.

Further, an information of position of the throttle valve 59 in the throttle body 41 is transmitted from the full-close switch 60 to a full-close position judging section 63 after an operation of the A/D conversion, and data of position of the throttle valve 59 obtained here is then transmitted to the calculating section 62.

Furthermore, an information of a shift position of the shift apparatus 15 is transmitted from the neutral switch 55 to a shift position judging section 64, and data of position of the shift apparatus 15 obtained here is then transmitted to the calculating section 62.

Still furthermore, an information of temperature of the cylinder 24 and the exhaust manifold 44 is transmitted from the cylinder temperature sensor 52 and the manifold temperature sensor 53 to a temperature detecting section 65, and data of temperature of the cylinder 24 and the exhaust manifold 44 obtained here is then transmitted to the calculating section 62.

The information obtained from each of the sensors and the switches is calculated by the calculating section 62 to thereby transmit suitable control signals to the solenoid control section 66, the ignition control section 67 and the fuel injection control section, respectively, so as to control the IAC solenoid valve 57 for adjusting the amount of air during the idling operation, the fuel injector 32 injecting the fuel within the intake port 30, and the ignition coils 54*a* and 54*b* for igniting the ignition plug 26.

By the way, in the case of the engine 5 for the outboard motor, the overheat of the engine 5 is generated, due to the shortage of the cooling water, at a time when the water intake port 18 for the cooling water is clogged by the algae or the water pump 19 gets out of order. In order to obviate this mater, the engine 5 is provided with an overheat control system or apparatus reducing the engine revolution number so as to restrict the increasing of the engine temperature.

Figure 5:
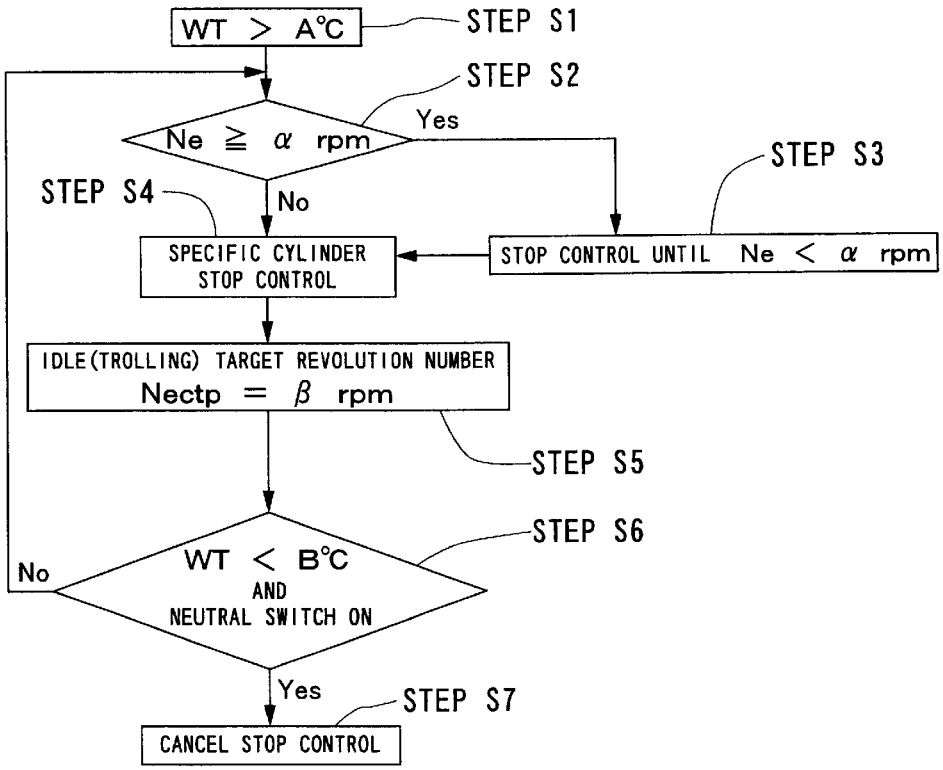
FIG. 5 is a flow chart showing a flow of a control executed by an overheat control system.
Figure 6:
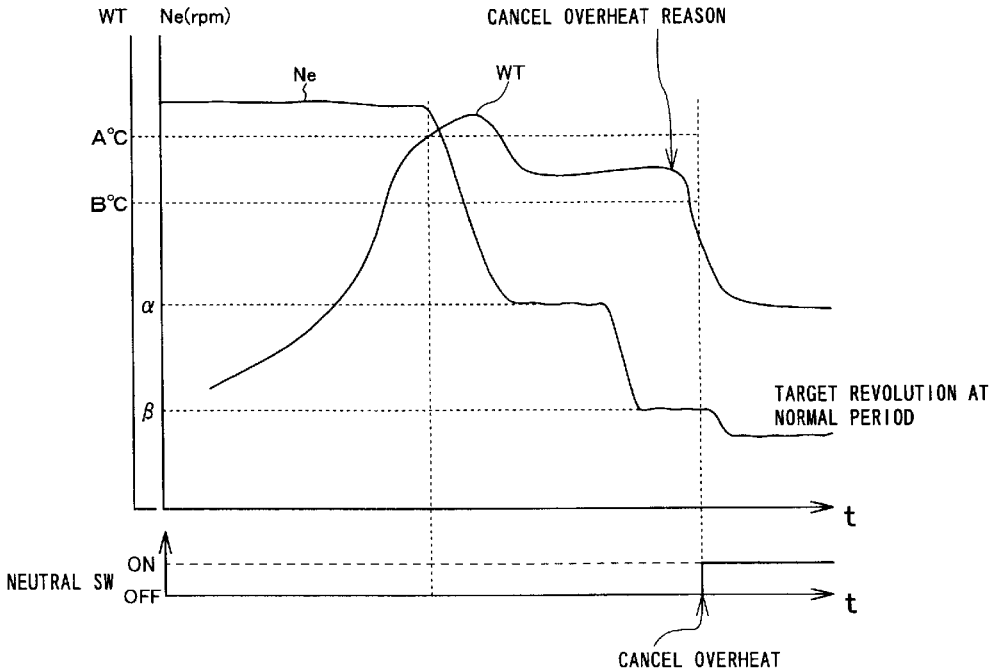
FIG. 6 is a graph showing a temperature characteristic on the basis of an overheat control.

FIG. 5 is a flow chart showing a flow of a control executed by the overheat control system, and FIG. 6 is a graph showing a temperature characteristic on the basis of this control.

With reference to FIGS. 5 and 6, since values of the temperature sensors of the cylinder 24 and the exhaust manifold 44 are always monitored by the control unit 50 as mentioned above, it is at first discriminated or judged whether values (WT) of the temperature sensors 52 and 53 are over a predetermined temperature of A° C., or not (step S1). In this case, the values of the temperature sensors 52 and 53 may employ a temperature ascending slope (an ascending rate) in addition to an absolute temperature.

In the case that the values of the temperature sensors 52 and 53 are over the predetermined temperature (i.e., WT>A° C.), it is discriminated that the engine 5 is in an overheat state, and it is discriminated whether a revolution number (Ne) of the engine 5 is equal to or more than a restriction (restricted) revolution number ($\alpha$ rpm) (Step 2). In this case, the revolution number of the engine 5 is always monitored by the control unit 50 as mentioned above.

In the case that the revolution number of the engine 5 is equal to or more than the restriction revolution number (i.e., $Ne \geqq \alpha$ rpm), the revolution number of the engine 5 is reduced by at least one of revolution number restricting controls including or among the misfire and the fuel stop around all the cylinders until the revolution number of the engine 5 becomes less than the restriction revolution number ($Ne < \alpha$ rpm) (Step 3).

In this case, since all the cylinders are in the operating (combustion) state even when the revolution number of the engine 5 is reduced until becoming less than the restricted revolution number in response to the revolution number restricting control, the engine temperature is again increased due to a long time operation, thus being defective.

There may provide no problem in the case that such defect, for example, caused by the clogging of the water intake port 18 or like, can be easily solved. However, in the case that the defect can not be solved on the scene, for example, a roughness on the sea condition, a trouble of the water pump 19 or the like, it is obliged for the engine to be continuously used forcedly, so that a further temperature increase of the engine 5 will be caused, and hence, there causes a fear that an excessive damage may be applied to the engine main body, equipments such as electrical equipment 37 or the like arranged at the peripheral portion thereof.

Accordingly, after the revolution number of the engine 5 is reduced to a value less than the restricted revolution number in the step S2 or the revolution number of the engine 5 is reduced to be less than the restricted revolution number in the step S3, the specific cylinder is controlled to be stopped by at least one means of the misfire and the fuel stop (step S4). Under such operation stop control of the specific cylinder, a fresh and cool air passes through the specific cylinder of the engine 5 in the overheat state without burning to thereby promote the cooling from the inner portion of the engine. Thus, according to this manner, the temperature increase of the engine 5 is restricted and it becomes possible to continuously use the engine 5.

Further, the cylinder controlled to be stopped is generally exploded in accordance with an order of 1-3-4-2 (first-third-fourth-second cylinders in arrangement) in the case of the four-stroke-cycle 4-cylinder engine 5, for example, as in the described and illustrated embodiment. Accordingly, the combustion is executed at 360° CA (crank angle) by selecting the first and fourth cylinders or the second and third cylinders so as to obtain the same combustion interval as that of the 2-cylinder engine, whereby the revolution of the engine becomes stable. In this case, the specific cylinder can obtain a sufficient effect even in only one cylinder.

Further, in the case of a 3-cylinder engine, the specific cylinder will become any one of cylinders, and on the other hand, in the case of a two-stroke-cycle 4-cylinder engine, the first and second cylinders or the third and fourth cylinders may be selected. Here, in the case of the two-stroke-cycle engine, only the misfire control is effective for the stop control.

In this case, when the specific cylinder among a plurality of cylinders is controlled to be stopped (i.e., is subjected to operation stop control), there is a fear that the revolution of the engine 5 becomes unstable at a time of fully closing the throttle valve 59 in the throttle body 41 such as in the idling time, trolling time or like. Accordingly, when the specific cylinder is controlled to be stopped in the step S4, an idling (trolling) target revolution number (Nectp) of the engine 5 is set to a revolution number (β rpm) higher than a target revolution number at a normal time (step S5). In this case, the target revolution number is executed by controlling the solenoid valve 57 by means of the control system 50.

In the case that the reason why the overheat is canceled during the operation stop control to the specific cylinder and the values of the temperature sensors 52 and 53 are less than the defined temperature (WT<B° C.), it is necessary to cancel the command of the operation stop control of the specific cylinder. However, in the case of suddenly canceling the stop control during this stop control of the specific cylinder, there may cause a fear that the revolution number of the engine 5 rapidly increases. Accordingly, it is detected by the neutral switch 55 whether or not the shift position of the shift apparatus 15 is in the neutral state, whereby the stop control of the specific cylinder is canceled (Step S7) only in the case that the values of the temperature sensors 52 and 53 are less than the defined temperature and the neutral switch 55 is in an ON-state (the shift position is neutral) (Step S6). Further, at this time, the idling (trolling) target revolution number is returned to the target revolution number at the normal (steady) operation period.

Even by reducing the revolution number of the engine 5 to be less than the restriction revolution number at a time when the engine 5 becomes in the overheat state, there is a case where the continuous use of the engine 5 is to be requested in some occasions or conditions, and it is impossible to completely prevent the temperature increase of the engine 5. Further, since the revolution number restriction control is applied to all the cylinders at random, the revolution of the engine 5 becomes unstable.

Accordingly, as mentioned above, by controlling the specific cylinder so as to reduce the revolution number of the engine 5 to be less than the restriction revolution number and then to perform the operation stop control, it becomes possible to prevent the engine temperature from being increased, even if the engine is continuously driven. Then, the prevention of the increasing of the engine temperature results in the stable state or condition of the engine main body and the equipment such as the electronic equipment 37 and the like arranged in the periphery thereof.

Further, if the specific cylinder controlled to be stopped is previously set in correspondence to the type or mode of the engine 5 (for example, in the case of the four-stroke-cycle 4-cylinder engine 5, the first and fourth cylinders or the second and third cylinders are selected as the specific cylinder), it is possible to obtain a stable engine revolution during the continuous use of the engine 5.

Furthermore, since the idling (trolling) target revolution number during the operation stop control of the specific cylinder is set to the revolution number higher than the target revolution number at the normal time, it is possible to obtain the stable engine revolution even in the low revolution number range of the engine 5, and it is also possible to prevent the engine stall or like.

Furthermore, at a time when the reason for the overheat is canceled and the values of the temperature sensors 52 and 53 are reduced to be less than the defined temperature, the operation stop control of the specific cylinder is canceled only at a time when the shift position of the shift apparatus 15 is in the neutral state. It is hence possible to prevent the defect or inconvenience caused by the rapid increase of the engine revolution number after canceling the stop control.

In the embodiment mentioned above, although there is provided a structure in which the present invention is applied to the engine 5 of the outboard motor 1, it is possible to apply to an engine of a motor car, a motorcycle and the like as far as it belongs to the water-cooled type multi-cylinder engine.

What is claimed is:

1. A control system of an engine of a water-cooled multi-cylinder structure, in which an engine revolution number is reduced to a level less than a restriction revolution number on the basis of at least one condition of revolution number restriction controls including misfire and fuel stop for all cylinders of the engine, at a time of an occurrence of an overheat of the engine, so as to restrict an increasing of a temperature of the engine, wherein in a case when the engine revolution number is less than the restriction revolution number after the overheat occurs, or the engine revolution number is lowered to be less than the restriction revolution number on the basis of the revolution number restriction control after the overheat occurs, a specific cylinder is controlled to be stopped by means of at least one of the misfire and the fuel stop.

2. A control system of an engine according to claim 1, wherein the specific cylinder controlled to be stopped by at least one means of the misfire and the fuel stop corresponds to first and fourth cylinders or second and third cylinders in a case of a four-stroke-cycle 4-cylinder engine, corresponds to first and second cylinders or third and fourth cylinders in a case of a two-stroke-cycle 4-cylinder engine, and corresponds to any one of cylinders in a case of a 3-cylinder engine.

3. A control system of an engine according to claim 1, wherein when the specific cylinder is controlled to be stopped on the basis of the occurrence of the overheat, an idle target revolution number of the engine is set to a revolution number higher than a target revolution number at a time of normal operation period.

4. A control system of an engine according to claim 1, wherein when a reason of the overheat is cancelled during the stop control of said specific cylinder, said stop control of the specific cylinder is set to be cancelled only at a time when a shift apparatus takes a neutral shift position.

5. A control system of an engine according to claim 1, wherein the engine is an engine for an outboard motor in which a crankshaft is vertically arranged.

6. A control system of an engine of a water-cooled multi-cylinder structure for controlling a revolution number of the engine, comprising:

means for detecting an occurrence of an overheat of an engine;

means for monitoring and detecting an engine revolution number;

means for discriminating whether the detected engine revolution number exceeds or not a restriction revolution number after occurrence of the overheat; and means for performing an operation stop control to a specific cylinder by means of at least one condition of revolution number restriction controls including misfire and fuel stop to thereby reduce the engine revolution number.

7. A method of controlling an engine of a water-cooled multi-cylinder structure for controlling a revolution number of the engine, comprising the steps of:

detecting an occurrence of an overheat of an engine;

monitoring and detecting an engine revolution number;

discriminating whether the detected engine revolution number exceeds or not a restriction revolution number after occurrence of the overheat; and performing an operation stop control to a specific cylinder by means of at least one condition of revolution number restriction controls including misfire and fuel stop to thereby reduce the engine revolution number.

* * * * *